United States Patent [19]

Seidl

[11] Patent Number: 4,701,111

[45] Date of Patent: Oct. 20, 1987

[54] REGULATION OF VANE PUMPS

[75] Inventor: Günther Seidl, Heubach, Fed. Rep. of Germany

[73] Assignee: Zahnradfabrik Friedrichshafen, AG., Friedrichshafen, Fed. Rep. of Germany

[21] Appl. No.: 849,504

[22] PCT Filed: Jul. 6, 1985

[86] PCT No.: PCT/EP85/00332

§ 371 Date: Mar. 6, 1986

§ 102(e) Date: Mar. 6, 1986

[87] PCT Pub. No.: WO86/00671

PCT Pub. Date: Jan. 30, 1986

[30] Foreign Application Priority Data

Jul. 12, 1984 [LU] Luxembourg ..... PCT/EP84/00214

[51] Int. Cl.[4] ..... F04B 49/00; G05D 11/00

[52] U.S. Cl. ..... 417/300; 417/310; 137/117

[58] Field of Search ..... 417/300, 310; 137/117

[56] References Cited

U.S. PATENT DOCUMENTS 3,547,559 12/1970 Fittman ..... 417/300
4,047,846 9/1977 Komamura ..... 417/300
4,311,161 1/1982 Narumi ..... 417/300
4,536,133 8/1985 Seidl ..... 137/117

*Primary Examiner*—William L. Freeh
*Attorney, Agent, or Firm*—Zalkind & Shuster

[57] ABSTRACT

A regulatable vane pump is provided with a piston operable by differential pressure responsive to booster steering flow demand wherein the piston movement controls a choke bore flow area. The differential pressure is effected by pump pressure on one face of the piston and consumer pressure on the opposite face of the piston, e.g., pressure in a booster steering servomotor. The choke bore has an aperture covered or uncovered by a choke plate carried by a pin on the piston. The choke plate is normally in position so as not to impede flow through the choke and the piston is in a position such that pump outlet flow is blocked from a bypass passage back to the pump inlet. However, with rise in vehicle speed under non-steering conditions, causing pressure on the one face of the piston to shift it along with the choke plate, the choke bore is closed, or partially so, and the unnecessary output pressure flow shunted back to pump inlet. Under steering conditions the back pressure on the opposite face of the piston reverses the piston to open the choke bore, all dependent on vehicle speed and rapidity of the steering operation.

18 Claims, 9 Drawing Figures

FIG. 3
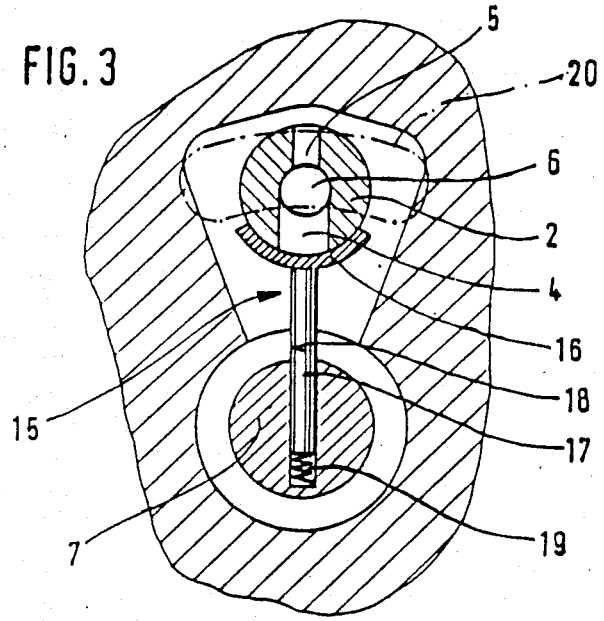
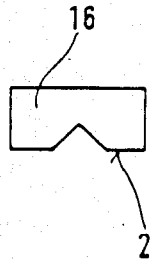
FIG. 4
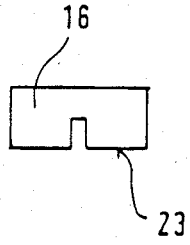
FIG. 5
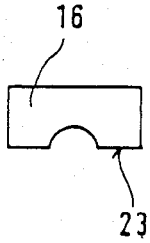
FIG. 6
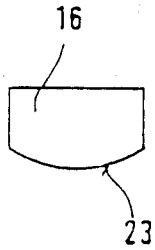
FIG. 7
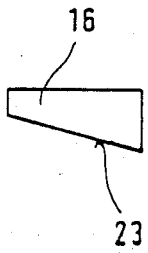
FIG. 8
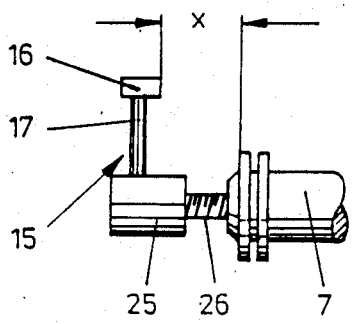
FIG. 9

REGULATION OF VANE PUMPS

BACKGROUND OF THE INVENTION

Vane pumps, in particular, are used very frequently for supplying auxiliary power steering mechanisms with pressure oil. Narrowing the pressure channel at an output flow point is a known way of controlling the stream of oil being delivered for the auxiliary power steering mechanism. This method causes a higher velocity of flow, and consequently a reduction of the static pressure on the booster piston or consumer end of the flow-regulating piston. Thus, the differential pressure between the flow regulating-piston end surfaces become greater and the flow-regulating piston is caused to shift responsive to the rate of pump speed, which is dependent on engine speed and thus corresponds to vehicle speed. Consequently, the flow admission port into the bypass or return channel for oil flow from pump outlet to inlet, or suction side, is opened to a corresponding extent. Accordingly, more hydraulic fluid is recirculated in the pump and the flow of oil to the consumer decreases. A dropping or falling characteristic curve of the vane pump occurs, i.e., the pump discharge is not increased with the work done by the vane pump after a certain cutoff point is reached, but is even reduced, if desired.

Certain characteristic curve variants are desired for various reasons. Thus, or example, a falling characteristic curve provides better steering operation in an auxiliary power steering mechanism at high speeds. Furthermore, the booster pressure in the steering system decreases when the characteristic curve of the flow of oil is falling if the speed is increasing. The result is a smaller consumption of power by the pump, and that effects lower temperatures.

For energy saving reasons and to avoid high oil temperatures, it is desirable to have small oil volume flowing through the booster system, especially when driving on a high-speed straight stretch of road. On the other hand, a high flow of oil should be available for a steering operation when operating pressure is high.

A known device for regulating vane pump is disclosed in applicant's German Patent No. DE-OS No. 32 11 948, the U.S. counterpart being U.S. Pat. No. 4,536,133 issued Aug. 20, 1985 to applicant. In that patent a leaf spring is fastened to the front of the flow-regulating piston to control flow through choke bores 14,15. During the movement of the flow-regulating piston, the free end of the leaf spring effects reduced flow through the choke bore(s). Thus, a decreasing characterisic curve of the flow of oil is obtained through the entire speed range after a certain speed cutoff point (28 on FIG. 8 of U.S. Pat. No. 4,536,133) is reached. Consequently, a predetermined characteristic curve pattern can be effected.

BRIEF DESCRIPTION OF THE PRESENT INVENTION

The present invention provides greater variation in the characteristic curve pattern.

A choke member having a choke bore is disposed so that a choke plate carried by the flow-regulating piston can slide across the choke bore to restrict flow to the bypass channel responsive to speed. By such construction, numerous characteristic curve variants can be achieved by shaping the leading edge of the choke plate, e.g., linear, curved, etc. Thus, a varied selection of choke plates may be used. Such arrangement is very simple and safe. The movement of the choke plate is parallel to the movement of the flow-regulating piston and no leaf spring is required. Accordingly, there is no danger of a fatigue fracture, e.g., of the leaf spring. Furthermore, the regulator piston with the choke plate can be produced easily at a favorable price.

In the embodiment of the invention the choke member is a tube parallel to the flow-regulating piston and the choke bore is located in a circumferential wall of the tube.

A space-saving arrangement is achieved in that the choke plate need not connect at the extended front of the regulator piston, as required for a bendable leaf spring which also has to be rigidly attached to the regulator piston. The choke plate of the invention can be installed or removed easily. Accordingly, choke plates can be readily changed to make changes in the characteristic curves of steering operation at any time.

Thus, regulating devices can be manufactured in production and assembled to conform to selected requirements for choke plate selection.

The choke tube member and choke plate can be contiguously cylindrical in shape for simple production and accurate throttling coaction.

The choke plate and tubular choke member can be designed with large tolerances since the choke plate can be held against the circumferencial wall of the choke tube by a spring in ways to be described. Also, different distances between the choke plate and piston are usable.

Thus, a spring makes installation easier. Further, the choke tube can abut the cheek or pressure plate of the pump pressure chamber to make installation easier while making sure that the choke plate is held against the choke tube member. Accordingly, additional safety measure are rendered unnecessary.

If the choke bore be offset on the circumference of the choke tube with respect to the choke plate, additional characteristics can be effected. For example, a lateral edge of the choke bore can become a leading edge and the choke bore or bores can be given any desired shapes. Likewise, the choke plate, in conformity with the choke bore, can have any desired shape for variations of closure coaction with a choke bore or bores of varying shape to achieve a variety of regulatory characteristics.

A very advantageous feature of the invention is the provision of a simple bore, e.g., of a circular cross section in the choke tube, in addition to the choke bore, for separate passage of pump discharge to a consumer for improvement in cold-starting of a vehicle's steering mechanism.

For ease of installation, the regulating piston can be provided with a transverse slidably keyed pin which carries the choke plate against the choke tube. This also permits ease of disassembly.

Other advantages and features of the invention will be apparent from the detailed description to follow in conjunction with the appended drawing, in which:

FIG. 3 is a section on the line III-III of FIG. 2.

FIGS. 4 through 8 show various possible shapes of choke plates, as seen in profile, FIG. 6 being preferred.

FIG. 9 shows a modified flow-regulating piston corresponding to FIG. 2, but on a small scale and having a regulating piston carrying a choke plate which is longitudinally adjustable by means of a threaded screw.

Figure 1:
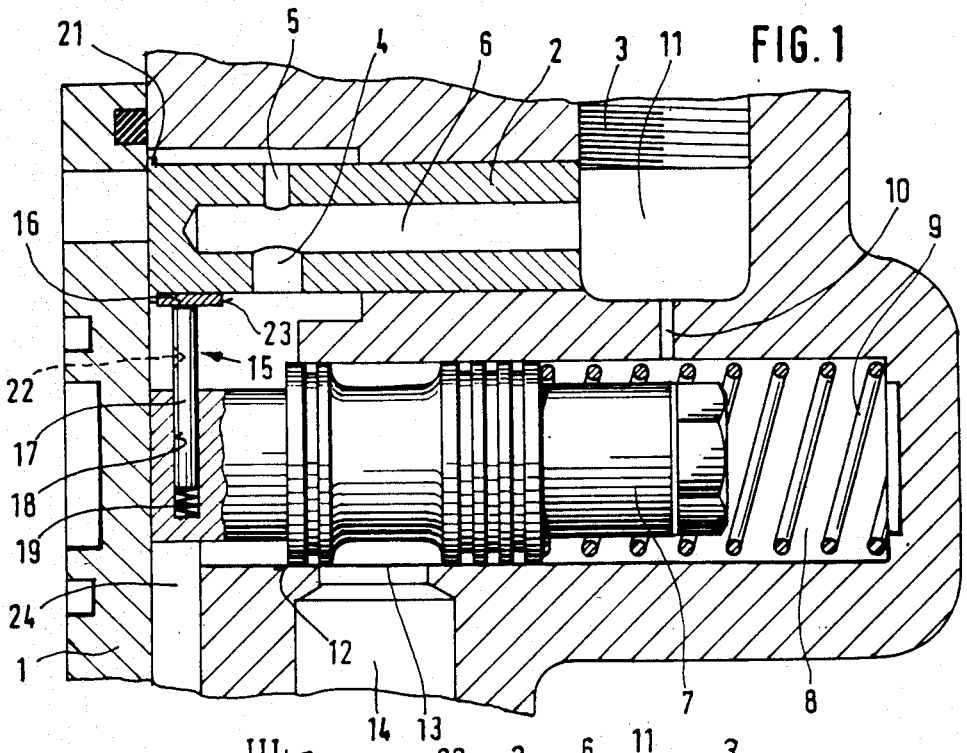
FIG. 1 shows a longitudinal section through a vane pump with the flow-regulating piston components of the invention in the closed position to prevent bypass of pump output to inlet.

The vane pump's construction is essentially conventional. Only those parts that are essential to illustrate the invention are represented in detail in the drawing.

Thus, the pump will be understood to have a rotor with blades, in the usual manner, and being located between a front plate (not shown) at the front and a rear pressure plate 1 (FIG. 1). Behind the pressure plate 1, there is a pressure chamber 24 understood to be connected for flow from pressure cavities (not shown) by pressure passages (not shown).

Output pressure passes through a tubular choke member 2 to a pressure output port 3, from which a passage can lead to a consumer, for example, an auxiliary power steering mechanism.

The choke member 2 is in the form of a tube or cylinder as shown. A choke bore 4 and additional bore 5 are through the circumferential wall. Communication from the outlet pressure chamber 24 to the port 3 is through the bores 4 and 5, with the choke member 2 being provided with a longitudinal bore 6 for that purpose.

The front end of a flow-regulating piston 7 projects into the pressure chamber 24, and abuts the outer side of the pressure plate 1 as a limit stop. The flow-regulating piston 7 is located slidably shiftable in a bore in the housing or the cover of the vane pump. The rear surface of the flow-regulating piston 7 is exposed in a spring chamber 8 in which a spring 9 exerts a bias force on the flow-regulating piston in the direction of the pressure plate to prevent bypass flow. The chamber 8 is connected with a pressure chamber 11 through a transverse bore 10, pressure chamber 11 being located adjacent the choke member 2 to receive pump output pressure.

The flow-regulating piston 7 is provided with a leading edge 12 which coacts with admission port 13 for flow to return or bypass conduit 14 for return of pump output to the inlet or suction side of the pump.

The tubular choke member 2 and the flow-regulating piston 7 are parallel to each other. The admission port of the choke bore 4 is axially transverse, i.e., perpendicular to the longitudinal axis of the flow-regulating piston 7. A flow restrictor means 15 consists of a choke plate 16 and a pin 17. The pin 17 is located in a transverse bore 18 in the flow-regulating piston 7. The transverse bore 18 is a blind-hole bore and a spring 19 is compressed between the bottom of the blindhole bore 18 and the rear end of the pin 17. Thus, the choke plate is always pressed against the circumferential wall of the choke member 2.

As can be seen from FIG. 3, the choke plate 16 has the shape of a segment of a hollow cylinder whose internal diameter at least approximately conforms to the external diameter of the tubular choke member to provide good sealing and throttling effect. Furthermore, the restrictor means 15 also comprises a protective device against twisting on the flow-regulating piston by slidably keying in the blind bore and it can be manufactured easily and at a favorable price as a die casting or injection molding. Various materials, including plastics, are usable.

Instead of the one choke bore 4 that is shown, several choke bores can be located in tandem longitudinally or around the circumference in the choke member 2, if desired. When that is done, choke bores can also be offset around the circumference with respect to the choke plate 16. In this way, a partial masking and consequently also a certain independence of the regulating piston's stroke becomes possible, if desired.

In FIG. 3, a pressure cavity 20 through which the pressure chamber 24 is supplied with pressure oil is indicated with broken lines.

Figure 2:
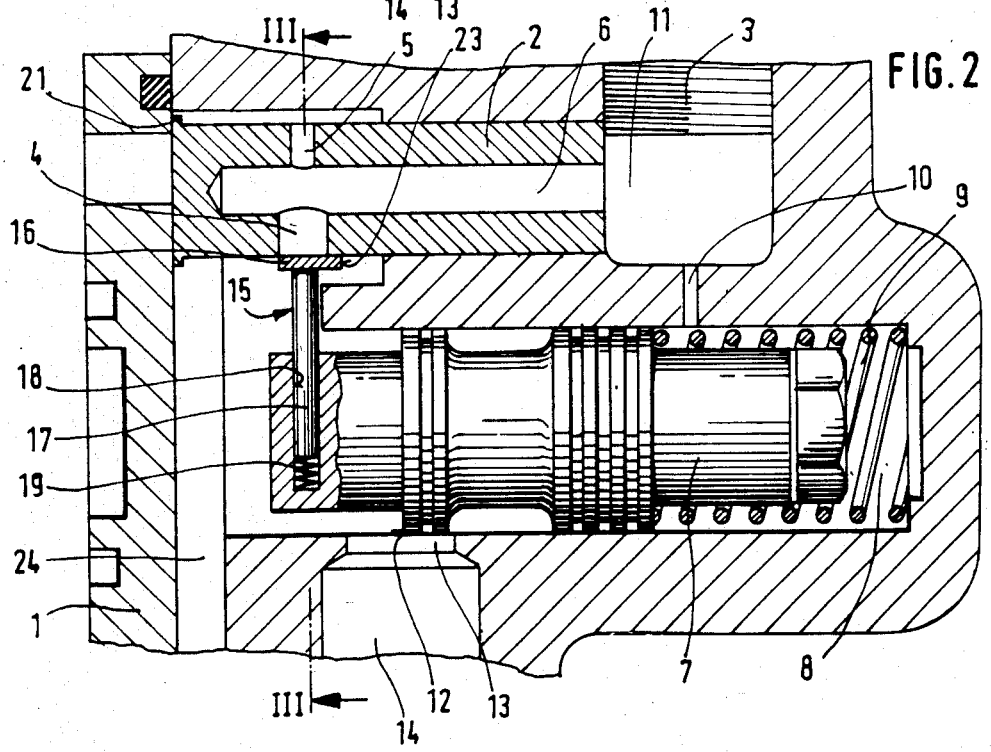
FIG. 2 shows a longitudinal section corresponding to that shown in FIG. 1, but with the flow-regulating piston shifted to permit bypass flow.

As can be seen in FIGS. 1 and 2, the front end of the cylindrical choke member 2 that projects into the pressure chamber 24 has a radial flange 21 that abuts the pressure plate 16 on one side and limits the axial movement of choke plate 16 under bias of spring 9. Furthermore, the pin 17 of the restrictor means 15 can be provided with a keyway 22 to maintain axial alignment.

Thus, easy starting of installation and disassembly is provided.

Various embodiments of the choke plate 16 are shown in plan view in FIGS. 4 through 8. In addition to a simple rectangular shape, as is shown in FIGS. 1 through 3, shapes can be selected in which the front edge 23, in particular, is something other than a straight line. In this way, the possibilities of variation where characteristic curve patterns are concerned become even greater. Furthermore, additional changes in operation by using a modified choke plate 16 can be done easily.

Characteristic curves that have reduced dropping off are obtained at the beginning of the area of overlapping with the embodiments shown in FIGS. 4 through 6. Especially with an embodiment as shown in FIG. 6, concavely semicircular at the front edge 23, a partial straightening of the characteristic curve is obtained since the choke bore 4 is more restrictively closed at the beginning of traverse.

An opposite effect is obtained with an embodiment such as is shown in FIG. 7. In that case, the characteristic curve pattern can even rise slightly after the cutoff point is reached.

FIG. 8 shows a front edge 23 with an inclined edge.

The examples shown in FIGS. 4 through 8 are to be regarded as only a part of a large number of possibilities. Depending upon the use to which they are to be put in each case and upon the desired chracteristic curve pattern, a number of possible variations are presented here.

The operation of the invention functions is as follows:

When the vane pump starts up, and up to a cutoff point with increasing speed, the flow-regulating piston 7 is in the closed position shown in FIG. 1. The pressure chamber 24 is not connected with the bypass admission port 13 to the return conduit 14 for the flow of oil to the pump inlet because of the closed position of the leading edge 12 of the flow-regulating piston 7. The pressure medium coming out of the presure cavities generally flows through the constant area bore 5 and the choke bore 4 into the choke member 2, and from there through the central longitudinal bore 6 to the outlet port 3. There is an appropriate pressure difference between the pressure chamber 24 and the spring chamber 8. Up to the cutoff point, the volume flowing through increases correspondingly as the pump speed increases. The piston 7 goes through an opening movement after the cutoff point is passed which point is determined by flow through the bores 4 and 5. A connection between the pressure chamber 2 and the return conduit 14 is produced in that way and the surplus pressure medium can flow out of the two pressure cavities in appropriate quantities and be returned to the suction side of the pump.

However, as a result of the flow-regulating piston's opening movement, the restrictor means 15 approaches the choke bore 4 with the choke plate 16. If the flow-regulating piston now is moved further, the choke plate 16 increasingly moves edgewise over the choke bore 4. In this way, a gradual throttling is achieved.

Now, as soon as the hydraulic steering mechanism is activated, the flow-regulating piston 7 goes through a reverse, closing, movement because of the back pressure from the consumer into the spring chamber 8. This, in turn, results in a complete or partial opening of the choke bore 4. In this way, a greater quantity of oil is made available to make certain of adequate speed of steering, particularly when steering in the upper speed range. At high rates of speed on long straight road stretches, only a small flow-through of volume takes place. But, if steering is to take place at this high rate of speed, wherein the operating pressure increases accordingly, the volume flowing through, i.e., oil circulation, increases correspondingly and with increasing pressure. As a result, a volume flow sufficient for steering is always available.

The bore 5 serves the purpose of improving cold-starting steering performance. In this case, in fact, it only functions in the open position and the danger of cavitation is reduced because of the small quantity flowing through.

A transverse bore that passes through the end of regulating piston 7 can be used instead of a blind-hole bore 18, if desired. In this way symmetry is obtained and no mistakes in installation can occur. In this embodiment, the spring 19 is then located between the bottom of the choke plate 16 and the circumferential wall of the flow-regulating piston 7 around the pin 17.

The dimensions of the longitudinal bore 6 in the choke member can be such that it determines the cutoff point. For this purpose, it is only necessary that the flow-through cross sections of the choke bore 4 and the bore 5, together, should be larger than the flow-through cross section of the longitudinal bore 6.

In addition to an improvement of cold-starting performance by the bore 5, that bore can also serve the purpose of influencing the characteristics of the characteristic curve. The dropping tendency of the characteristic curves can be influenced by it, depending upon bore size.

In FIG. 9, on a reduced scale, the front area of a flowregulating piston 7 is shown in which the pin 17 of the servopiston 15 is not inserted directly in a transverse bore 18 of the flow-regulating piston 7. Instead, the lower part of the servopiston 15 has a base part 25 with a threaded screw 26. There the pin 17 is also inserted in a transverse bore of the base support 25 or it and the base support 25 can constitute a single piece. In this case, the front face of the flow-regulating piston 7 has a threaded bore into which the threaded screw 26 of the restrictor means 15 can be screwed. The advantage of this embodiment by comparison with the embodiments that have been discussed is in the fact that the distance "x" is adjustable and can even be changed subsequently, if desired. That means that changes in the characteristic curves are possible in this way, and as a result the device of the invention can be adapted to the existing circumstances in the best way possible. It is only necessary that securing of the threaded screw 26 in its adjusted position is made after a final adjustment.

I claim:

1. In a device for regulating the output of a vane pump of the kind wherein a pressure operated piston has one face exposed to outlet pressure of a vane pump and an opposite face exposed to servomotor pressure wherein the position of the piston is responsive to differential pressure on the piston faces, and including a bypass passage wherein outlet pressure flow of the pump can return to the pump inlet or be blocked therefrom dependent on piston position;

the improvement which comprises means (2) having a choke bore (4) and an outlet passage (6) for pump flow to a consumer;

said choke bore communicating between said outlet passage and said one face of said piston exposed to pump outlet pressure and being axially perpendicular to the axis of said piston;

a choke plate (16) carried by said piston to move longitudinally therewith and disposed to slidably cross over said choke bore transversely of the axis thereof to closr or open said choke bore responsive to differential pressure on the faces of said piston.

2. In a device as set forth in claim 1, including means 26 for carrying said choke plate on said piston comprising a pin secured to said choke plate and carried by said piston and having means (22) for aligning said choke plate.

3. In a device as set forth in claim 2, including further means for axially adjusting the position of said pin on said piston.

4. In a device as set forth in claim 1, including another bore (5) in said choke member communicating with said pressure chamber and said outlet passage to facilitate cold starting of a vehicle steering system.

5. In a device as set forth in claim 1, wherein said means (2) comprises a choke member (2) having a wall through which said choke bore extends to communicate said outlet passage with pressure to which said one face of said piston is exposed.

6. A device as set forth in claim 5 wherein said choke bore has an axis intersecting the axis of said piston.

7. A device as set forth in claim 5 wherein said wall through which said choke bore passes is curved.

8. A device as set forth in claim 7, wherein said choke plate is curved in conformity with said curved wall.

9. In a device as set forth in claim 8, including a spring biasing means supporting said choke plate in engagement with said curved wall.

10. In a device as set forth in claim 9, said spring biasing means comprises a bore (18) in said piston, a pin (17) extending out of said bore and carrying said choke plate and a spring (19) in said bore biasing said rod to effect engagement of said choke plate with said wall.

11. In a device as set forth in claim 10, wherein said wall has curvature in the area of opening of said choke bore across which said choke plate is slidable and said choke plate has complementary curvature.

12. In a device as set forth in claim 5, including a housing, said choke member being carried in said housing and a vane pump pressure plate (1) abutted by said choke member for fixing said member in said housing.

13. In a device as set forth in claim 12 said housing having a pressure chamber (24) for receiving pressure flow from said vane pump; said pressure chamber extending around said choke member for pressure flow through said choke bore to said outlet passage (6).

14. In a device as set forth in claim 13 wherein the choke bore is a slot.

15. In a device as set forth in claim 13 wherein the choke plate has a straight edge movable across said choke bore.

16. In a device as set forth in claim 13 wherein said choke plate has a non-linear edge movable across said choke bore.

17. In a device as set forth in claim 13 wherein said choke plate has a straight edge oriented to move broadside across said choke bore.

18. In a device as set forth in claim 13, wherein said choke plate has a straight edge oriented to move slantingly across said choke bore.

* * * * *